United States Patent [19]

Tremain et al.

[11] Patent Number: 4,561,305

[45] Date of Patent: Dec. 31, 1985

[54] LIQUID SIGHT GAGE COVER

[75] Inventors: David L. Tremain, Sterling; Burt L. Beach; David J. Rimington, both of Prophetstown, all of Ill.

[73] Assignee: Houdaille Industries, Inc., Fort Lauderdale, Fla.

[21] Appl. No.: 502,937

[22] Filed: Jun. 10, 1983

[51] Int. Cl.[4] ..... B65D 25/54

[52] U.S. Cl. ..... 73/323; 73/325

[58] Field of Search ..... 73/323, 325, 326, 327, 73/328, 329, 330, 331, 332, 333, 334, 324

[56] References Cited

U.S. PATENT DOCUMENTS

| | | | |
|---|---|---|---|
| 890,742 | 6/1908 | Whitney | 73/327 |
| 925,361 | 6/1909 | Lovekin | 73/327 |
| 1,234,924 | 7/1917 | Morse | 73/330 |
| 1,395,062 | 10/1921 | Sargent | 73/326 |
| 2,633,023 | 3/1953 | Van Ham | 73/323 |
| 2,767,586 | 10/1956 | Jancosek et al. | 73/329 |
| 4,014,214 | 3/1977 | Ponterfract | 73/330 |

FOREIGN PATENT DOCUMENTS

| | | | |
|---|---|---|---|
| 318194 | 5/1934 | Italy | 73/325 |
| 120896 | 6/1927 | Switzerland | 73/330 |
| 263638 | 1/1927 | United Kingdom | 73/330 |

*Primary Examiner*—Charles Frankfort
*Assistant Examiner*—David R. Schuster
*Attorney, Agent, or Firm*—Fitch, Even, Tabin & Flannery

[57] ABSTRACT

A liquid level sight gage has an elongated chamber block with a liquid chamber, a lens covering the liquid chamber, and a cover with an elongated viewing slot secured to the block with the lens interposed therebetween. Side beams of the cover, through which bolts securing the cover to the chamber block extend, have ovate configurations, providing greater mass at their centers, thereby providing greater support towards the centers of the chamber block sidewalls where the tendency to bulge is greatest. The bolts extend through longitudinally spaced holes in the side beams in contact with the chamber sidewalls and are transversely supported by the side beams.

15 Claims, 13 Drawing Figures

LIQUID SIGHT GAGE COVER

The present invention relates to high pressure liquid sight gages and more particularly to gages having improved covers.

BACKGROUND OF THE INVENTION

In large tanks or vessels where liquids are stored or processed, sight gages, having chambers that become filled with liquid to the level of liquid within the tank, provide a very accurate and easily read measurement of liquid level. In many liquid handling and processing applications, the liquid in the tank is under high pressure, and sight gages for such applications are constructed to withstand these high pressures.

A reflex liquid level sight gage conventionally consists of a rectangular metal block in which is formed a trough-like chamber. End ports communicate the chamber to a liquid-carrying pipe or conduit. The block face to which the chamber opens, is covered with a thick glass lens, and a metal cover is bolted to the chamber, e.g., by means of a plurality of U-bolts, over the lens to hold it under compression against the chamber with an interposed gasket. Conventionally, the cover is rectangular in shape having a pair of spaced-apart side beams that fit over side portions of the lens, and a pair of end sections joining the side beams, thereby defining an elongated central viewing slot.

Similar to the reflex sight gage is a transparent sight gage in which the chamber extends through the chamber block, opening to opposed faces. A lens and cover are fitted over both faces, the covers being held together in compression against the lenses by a plurality of straight bolts extending through the side beams.

The cover holds the lens in compression against the chamber block to maintain a gasket seal, and the cover also provides support to the chamber blocks so that the sidewalls do not bulge excessively in response to pressures exerted by pressurized liquid in the chambers and cause the gasket seals at the lens-chamber block interfaces to fail. To provide the necessary support, the covers have substantial resistance to deformation as a result of their construction. However, the conventional rectangular cover does not provide optimal support relative to its mass because its design fails to account for varying stresses to which it is subjected over its length. The sidewalls of the chamber block, whether in a reflex gage or a transparent gage, have spans which are supported at their ends and tend to bulge outward toward their centers in response to fluid pressure. Similarly, the side beams of the sight gage covers are suported at their ends and provide proportionately less support at their centers.

It is a primary object of the present invention to provide a liquid sight gage cover with greater resistance to deflection proportional to the amount of metal used in its construction and which therefore provides the gage with a higher pressure rating than conventional gages with similar mass.

SUMMARY OF THE INVENTION

Improved covers are provided for liquid sight gages which includes a cover; an elongated chamber block, generally in the shape of a rectangular prism, in which is formed a longitudinally extending liquid chamber, a lens on the chamber block covering the liquid chamber, a gasket or the like for forming a peripheral seal between the chamber block face and lens surface, and bolts for securing the cover to the chamber block with the lens interposed therebetween. Two such covers are used for transparent sight gages having a chamber opening to opposite faces of the chamber block with each opening covered by a lens. The cover is preferably formed of a unitary piece of metal and comprises a pair of longitudinally extending side beams connected by a pair of transversely extending end bars, defining a central viewing slot in alignment with the liquid chamber opening. The side beams have longitudinally spaced holes that receive bolts extending along the sidewalls of the chamber block.

In accordance with the invention, the side beams are configured to accomodate forces from the sidewalls either directly or through the bolts and are formed to provide progressively greater resistance to deformation toward their centers so as to resist the greater tendency of central portions of the liquid chamber sidewalls to deflect when subjected to pressure.

In accordance with another aspect of the invention, the greater resistance provided by the side beams is achieved by providing the side beams with ovate configurations, thereby providing greater amounts of material in the central portions of the side beams. Preferably, the side beams extend over the sidewalls and include ribs which extend inwardly to reinforce the bolts extending through the holes.

In general, gradually increasing the mass toward the centers of the side beams provides the improved results of the invention. The increase in such mass should be in proportion to the forces developed in the side beams intermediate the transversely extending end sections. The ribs reinforce the bolts but, at the same time, transmit forces to the side beams which also accomodate such transmitted forces.

In accordance with another aspect of the invention, the bolt holes are positioned in the side beams to extend bolt segments in direct contact with the chamber sidewalls, and portions of the side beams extend transversely outwardly of the sidewalls and along the sidewalls, contacting and supporting the bolts. Thus, forces from the sidewalls are transmitted to the ribs and to the side beams.

DETAILED DESCRIPTION OF THE PREFERRED EMBODIMENTS

Appreciation of the advantages provided by the cover 209 (FIG. 7) of the invention requires further understanding of the conventional prior art gage cover 9 (FIG. 1) and some understanding of how stresses in prior art high pressure liquid sight gages are distributed through the cover or covers. Therefore, the prior art liquid level gages will now be briefly described both in terms of a reflex gage 10, shown in FIGS. 1 and 2, and a transparent gage 110*a* shown in FIG. 6. Components of the new gage 210, embodying the present invention, are distinguished by the symbol prime (') from the corresponding components of the prior art gage 10.

Figure 1:
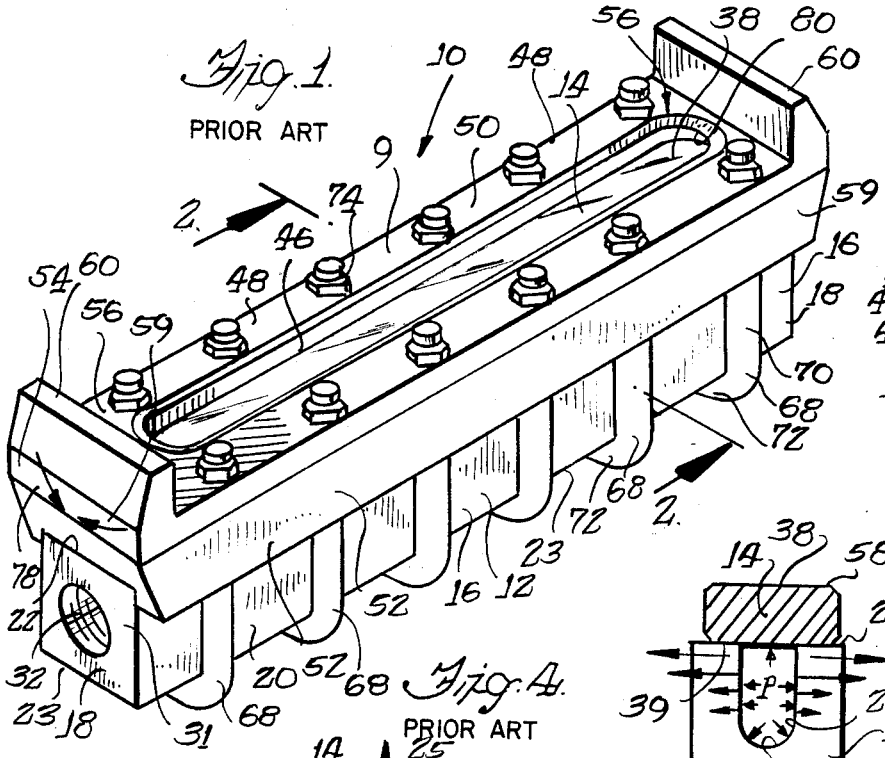
Fig. 1. PRIOR ART
FIG. 1 is a perspective view of a reflex liquid sight gage having a conventional prior art cover.
Figure 2:
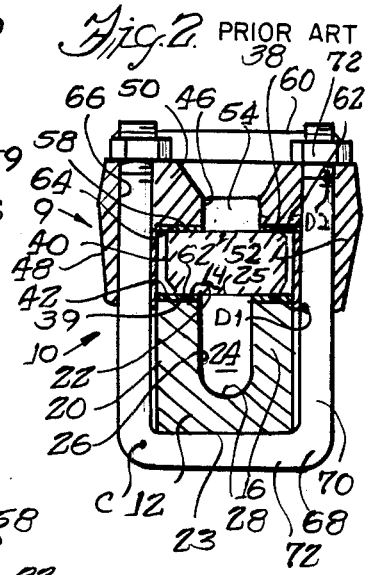
Fig. 2. PRIOR ART
FIG. 2 is a cross-sectional view taken along line 2—2 of FIG. 1.

The prior art reflex gage 10 illustrated in FIG. 1 has a single viewing face. The elongated chamber block 12 is generally a rectangular prism having ends 18, sides 20 and front and rear faces 22, 23 (FIG. 2). A liquid chamber 24 having a U-shaped transverse cross-section is provided having interior sides 26 parallel to the sides 20 of the chamber block 12 and an arcuate bottom 28. The chamber 24 has an elongated opening 25 in the top face 22 of the block 12 and terminates in arcuate ends 27 (FIG. 4) at the block end walls 31. Threaded bores or ports 32 (FIG. 1) extend through the end walls 31 to the liquid chamber 24 providing for attachment to a liquid conduit or pipe (not shown) and flow of liquid from the tank or vessel (not shown) into the chamber.

Covering the chamber opening 25 is a thick, transparent (generally glass) lens 14 having outer and inner surfaces 38, 39 through which the liquid in the chamber 24 is viewed. The lens 14 is longer and wider than the chamber 24, whereby a portion of the inner lens surface 39 extends along the front face 22 of the block 12 peripheral to the chamber opening 25. The edges of the lens 14 are generally parallel the edges of the chamber 24, the longitudinally extending side edges 40 being straight and the end edges 41 being arcuate. A gasket 42 is interposed at the periphery of the chamber 24 between the front face 22 of the chamber block 12 and adjacent portions of the inner lens surface 39 to form a seal between the lens 14 and chamber block 12 and to cushion the lens.

The prior art cover 9, which is machined from a unitary block of metal, is configured to overlie the lens 14, providing the elongated central viewing slot 46 through which the portion of the lens 14 that overlies the chamber opening 25 is exposed. Opposed side beams 48 of the cover 9 each has a generally L-shaped cross-section (FIG. 2), each side beam including a portion 50 that overlies the periphery 58 of the outer surface 38 of the lens 14 and a portion 52 that extends along the longitudinal edge 40 of the lens. End sections or bars 54 have similar L-shaped cross-sections, each including a portion 56 that overlies the periphery 58 of the outer lens surface 38 and a portion 59 that extends inward along the curved end 41 of the edge of the lens. An outwardly extending lip 60 of each end section 54 reinforces the same, helping to resist tensile forces resulting from side beam deformation. A gasket 62 is interposed between the periphery 58 of the lens and a complementary flat inner surface 64 of the cover 9, cushioning the lens.

As a means of holding the block 12, lens 14 and cover 9 together under compression to maintain a seal around the periphery of the chamber 24, a plurality of longitudinally spaced bolt holes 66 extend through the side beams 48 of the cover 9, and U-bolts 68 are inserted in the holes, each with its side legs 70 extending through a pair of opposed bolt holes and its connecting leg 72 extending transversely across the lower face 23 of the block 12. Nuts 74 are applied with appropriate torque to threaded ends of the U-bolts 68.

Figure 3:
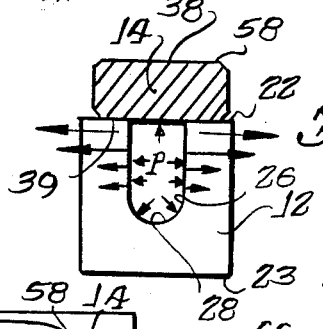
Fig. 3. PRIOR ART
FIG. 3 is a diminutive cross-sectional view of a chamber block and lens used either with the prior art cover of FIG. 1 or with covers according to the present invention.
Figure 4:
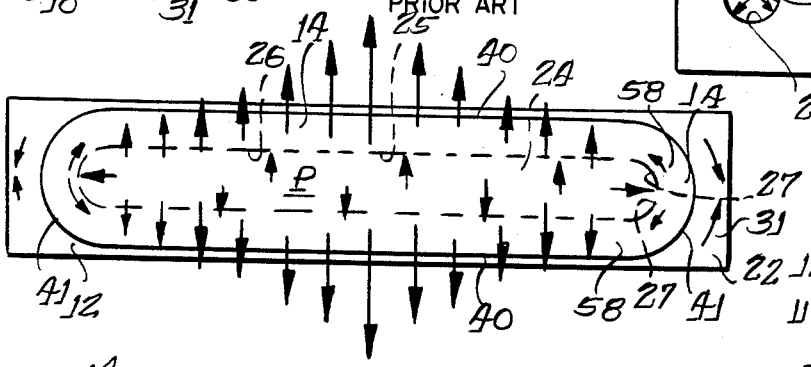
Fig. 4. PRIOR ART
FIG. 4 is a plan view of the lens and chamber of FIG. 3.
Figure 5:
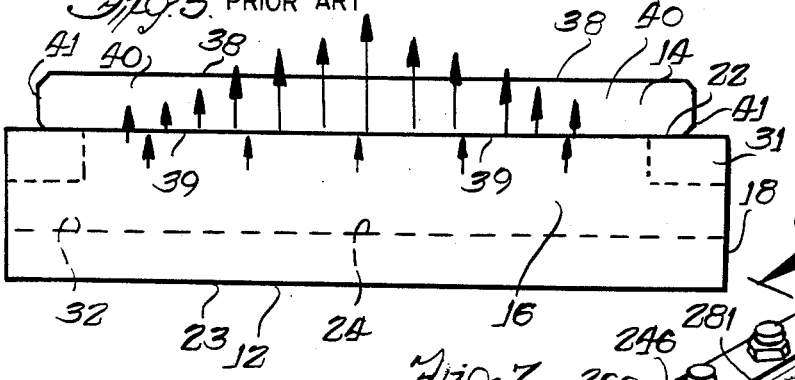
Fig. 5. PRIOR ART
FIG. 5 is a side elevation view of the lens and chamber of FIG. 3.

Referring now to FIGS. 3 through 5, the pressure exerted by liquid on the walls of the chamber block 12 and glass lens 14 (the chamber block and glass lens being equivalent in the prior art reflex gage and in the reflex gage of the present invention) is analyzed according to Pascal's law which states: "Pressure applied to an enclosed fluid is transmitted undiminished in all directions to every portion of the fluid and the walls of the containing vessel." When applied to a chamber and lens, the generally equal pressure (shown by the arrows internally of the chamber) tend to result in differential transverse deflection (shown by the arrows external of the chamber) of the sidewalls 16 of the chamber 24 and differential deflection of the lens 14. Because portions of the sidewalls 16 and lens 14 towards the center are less supported relative to portions adjacent to ends of the chamber 24, the center portions have a tendency toward greater deflection or bulging.

In a gage 10 in which the prior art cover 9 is used with a lens 14 and block 12, the cover provides no compensation for the greater deflection of the chamber sidewalls at the center. The cross section of each side beam 48 is uniform throughout the length of the vision slot 46.

The tendency toward differential deflection (FIG. 5) throughout the axial span of the lens 14 can be generally ignored because the compression applied by the bolts 68 is sufficient to substantially negate any differential deflection of the lens 14.

The tendency of the sidewalls 16 to bulge transversely toward their centers and the effects of this bulging on the cover 9 and bolts 68 will now be more fully discussed with reference to the cross-sectional view of the prior art reflex gage 10 seen in FIG. 2. The pressure exerts an outward force on the chamber sidewalls 16, and as the chamber sidewalls deflect outwardly, they bear on the lower portions of the side beams 48. Because the cover 9 is restrained against the lens 14 by the nuts 74 and bolts 68 but is not restrained transversely, the side beams 48 move transversely until the bolt holes 66 are contacting and pressing against the bolts 68 at their inside edges. The bolts 68 respond by bending outward at their corners (C) allowing the side beams 48 still more lateral movement. The bolts 68 realign themselves in their holes 66 until contact is established between the bolts and holes at points D1 and D2 (FIG. 2), and the strength of the bolts 68 is sufficient to prevent further transverse movement within the normal pressure ranges. However, the cover side beams 48 move sufficiently, particularly at their axial centers, to cause a significant redistribution of gasket loads, making pressure retention more difficult.

The stresses caused by greater transverse deflection of the side beams 48 at their centers are distributed to the end sections 54, and bulging of the side beams results in the outside edges 78 of the end sections being in compression (as represented by facing arrows at the upper right in FIG. 1) and the inside edges 80 being in tension (as represented by diverging arrows at the upper left of FIG. 1). The tension on the inside edges 80 contributes significantly to gage weakening and is a limit on the pressure capacity of the gage. The compression forces, on the other hand, can be largely ignored, as the cover will succumb to tension forces long before the compression forces become excessive.

Figure 6:
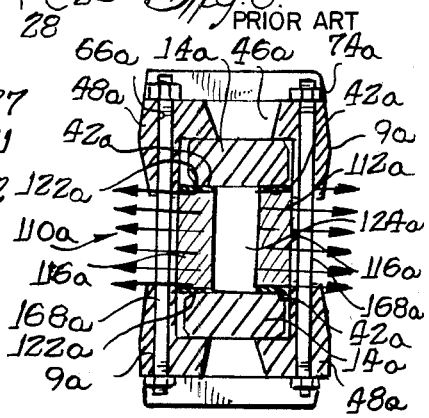
Fig. 6. PRIOR ART
FIG. 6 is a cross-sectional view of a liquid level transparent sight gage having a pair of prior art covers.

Illustrated in FIG. 6 is the prior art transparent gage 110*a* which utilizes covers 9*a* lenses 14*a*, and gaskets 42*a*, identical to those used in the reflex gage 10 of FIGS. 2 and 3. The chamber 124*a* formed in the block 112*a* differs only in that it extends entirely through the block, opening to opposed faces 122*a*. A lens 14*a*, cover 9*a* and gaskets 42*a* are applied to each face 122*a* of the chamber block 112*a*. Instead of U-bolts holding the chamber block 112*a* to the cover 9*a*, straight bolts 168*a* extend through aligned bolt holes 66*a*, and nuts 74*a* are applied to the threaded bolt ends to hold the covers 9*a* together, compressing the lenses 14*a* against the faces 122*a* of the block 112*a*.

The bulging of the sidewalls 116*a* bear against the lower end of the side beams 48*a*, resulting in transverse shifting of the side beams causing the bolt holes 66*a* to contact and press against the inside edges of the bolts 168*a*. The bolts 168*a* are relatively free to move transversely as there is no connection between opposed bolts, and the side beams 48*a* adjust more freely by lateral movement, offering little resistance to bulging of the sidewalls 116*a*. Thus the conventional prior art covers 9*a* do even less to oppose lateral displacement along the gasket seal in a transparent gage 110*a*.

The invention provides the improved gage cover 209 that is configured so as to provide greater resistance to deflection in those regions where the tendency to deflection is greatest and which generally distributes the forces in a manner so that it maximizes the pressure capacity of the gage 210. The new cover 209, having a substantially similar mass to that of a conventional pressure gage cover 9, gives the gage 210 substantially greater pressure capacity. The U-bolts 68' run directly along the chamber sidewalls 16' advantageously changing the stress analysis for the new gage 210 as explained in greater detail hereinafter.

Like the conventional prior art cover 9, the new cover 209 includes end bars or sections 254 and side beams 248 that define a central viewing slot 246. The side beams 248 have outer shells 282 (FIG. 8) having generally ovate configurations, providing total increased transverse dimensions to resist central bulging by the sidewalls 16' of the chamber 24'. The shells 282 also have additional depth extending a substantial distance over the sidewalls 16' at their axial centers.

Figure 13:
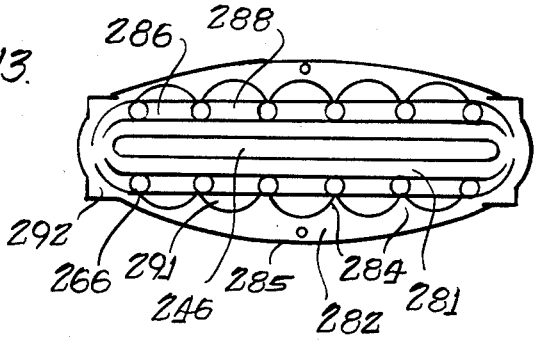
FIG. 13 is an elevation view of the interior of the cover of FIG. 9.

The shell 282 of each side beam 248 extends from its straight edge 281 adjacent to the viewing slot 246 to an ovate side edge 285, which at its ends is generally level with the front face 22' of the block 12' but which dips transaxially inward at its center a distance X (FIG. 8) generally at least about one-fourth ($\frac{1}{4}$), and preferably about one-third ($\frac{1}{3}$), of the depth of the sides 20'. Each of the side beams 248 has a flat peripheral interior surface 286 that overlies the outer surface 38' of the lens 14'; and beyond the flat peripheral surface, an interior surface 288 of the shell 282 generally parallels the ovate exterior surface 290, extending significantly transversely outwardly of the transverse edge of the chamber block 12'. Bolt holes 266 are formed through the shells 282, and opposed bolts holes are transversely spaced apart so that the rearwardly extending bolt legs 70' make direct tangential contact with the sidewalls 16' of the block 12'. The shells 282 support the chamber sidewalls 16' by means of a plurality of ribs 284 which extend inward from the interior of the shells and terminate in straight inner edges 287 that extend in contact with the sides of the bolts 68' remote from the chamber sidewalls 16' to transversely support the bolts 68' and thereby support the sidewalls. The ribs 284 extend generally to the depth of the ovate edges 285 of the shells 282. Hollow regions 291 (FIG. 13) between the longitudinally spaced ribs 284 reduce the total mass of the cover 209, whereby the side beams 248 have both additional transverse and depth dimensions relative to the side beams 48 of the prior art cover 9 without increasing the total mass of the cover.

The curved outer edge 278 of each end section 254 is generally continuous of the curvature of the ovate edges 285 of the shells 282. A lip 260 extends outwardly to provide additional end section reinforcement. Each end section 254 also carries a pair of protuberances 292 (FIG. 7) for attachment of auxiliary apparatus, such as a frost protector (not shown), used when the gage 210 contains cryogenic liquids. The interior edges 280 of the end sections 254 are generally parallel to the adjacent curved end edges of the lens 14'.

Figure 7:
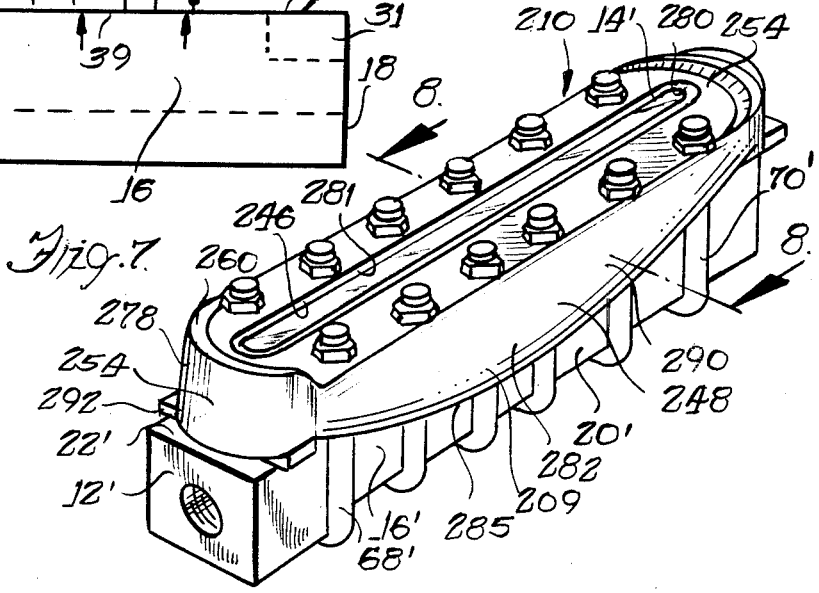
FIG. 7 is a perspective view of a reflex sight gage having a cover embodying various features of the present invention.

With references to FIG. 7, it is seen that in both in depth and in the transverse direction, the mass distribution of each shell 282 is greatest toward its center where the tendency toward chamber sidewall 16' deflection and side beam 248 deflection are greatest. As an approximate analysis, the greater central mass helps to resist the greater central lateral deflection. Also, the ovate configuration of the shell 282 provides substantial resistance to stress.

Figure 8:
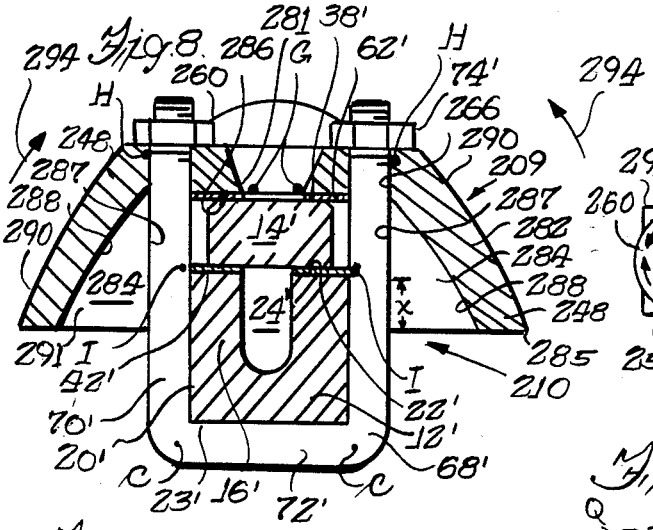
FIG. 8 is a cross-sectional view taken along line 8—8 of FIG. 7.

A more detailed analysis of how the design of the present invention minimizes lateral deflection in a reflex gage 210 will now be described in reference to FIG. 8. The force exerted by liquid in the chamber 24' is directly transmitted to the bolts 68' and from there transferred directly to the ribs 284. Deflection of the chamber sidewalls 16' at this point tries to cause rotation of the side beams 248 about point G, i.e., creates a bending moment about point G in the direction of the arrows 294, and the bending moment in the cover exerts compression forces at points H, causing a bending moment in the bolts 68' about points I; however, this bending moment is resisted by the rigidity of the bolts 68'. Bulging of the sidewalls 16' also tends to cause an outward bending moment of the U-bolts 68' at their corners (points C); however, this bending moment is resisted by the cover side beams 248 biasing the upper portion of the bolts in the opposite direction.

Figure 9:
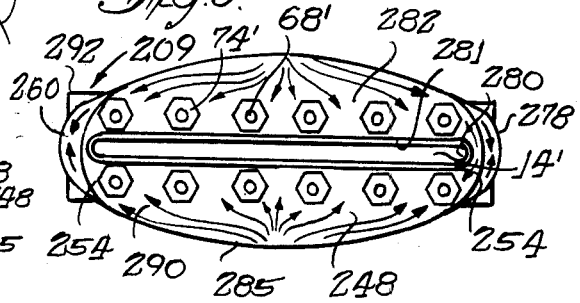
FIG. 9 is a diminutive plan view of the sight gage of FIG. 7 on which are drawn stress lines.
Figure 10:
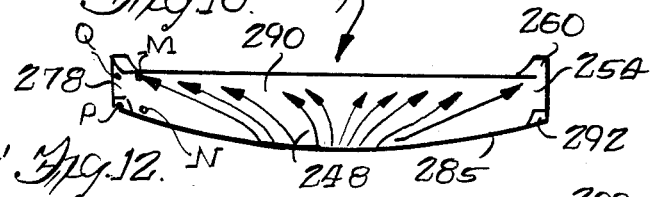
FIG. 10 is a diminutive elevation view of the gage of FIG. 7 on which are drawn stress lines.
Figure 11:
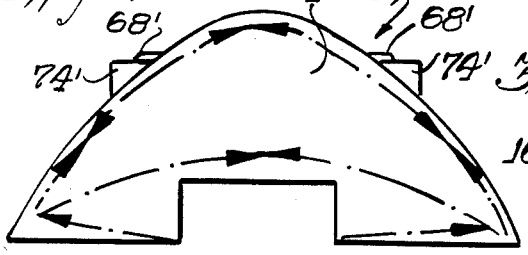
FIG. 11 is a diagrammatic end view of the cover of FIG. 7 with stress lines drawn.

The cover 209, configured according to the invention, in addition to resisting lateral deformation, reduces tension on the end sections 254. Stresses in the end sections 254 are the result of a combination of stress components represented in FIGS. 9 and 10, resulting from the lateral deflection of the cover side beams 248 and compression stress components represented in FIG. 11 resulting from the bending moment in the side beams about points G. (Converging arrows at a point represent compression and diverging arrows at a point represent tension.) As in the prior art cover 9, the inside edges 280 of the end sections 254 are subjected to a component of tension by the tendency of the center of the side beams 248 to bulge, while the outside edges 278 are subjected to a component of compression. The components of force, exerted on each end section 254 by the bending moment in the side beams 248 about points I, places components of compressive force on all portions of the end sections 254. At point M (FIG. 10) at the upper inside edge of the end section 254, the tension component is greater than the compression component, and this point M remains under a tension that is substantially reduced by the compression component. Point N at the lower inside edge 280 is under net compression forces. The end outside edge 278, points P (lower) and Q (upper), are also under compression. As stated above, tension rather than compression forces represent a pressure capacity limitation for a gage cover, and reduction or elimination of tension at points on the inside edges 280 of the end sections 254 increases the strength of the cover 209 and the pressure capacity of the gage 210.

Figure 12:
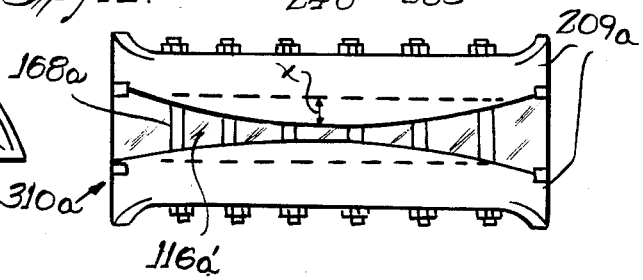
FIG. 12 is an elevation view of a transparent sight gage with a pair of covers embodying various features of the invention.

In the transparent gage 310*a* (FIG. 12), the two covers 209*a* provide the gage with substantial increased pressure capacity by resisting the tendency of the sidewalls 116*a*′ to bulge outward, much more than conventional covers resist sidewall bulging. Because the bolts 168*a*′ are not interconnected across the transparent 310*a* gage, the enhanced resistance to sidewall bulging is primarily due to the increased mass of the covers 209*a* at their centers.

Where additional stability against bulging is required, the chamber 24′ may contain cross-braces between the sidewalls 16′ (not shown) at one or more locations inward of its ends. However, because the chamber 24′ must be continuous from one end to another, these cross-braces do not extend the full depth of the chamber and the above analyses of stress generally apply.

The invention provides a fluid level gage cover which much better utilizes its mass in stabilizing the chamber block 12′ and the gasket seal between the block and the lens 14′. A size nine cover 209 according to the invention provides a gage rating of 4000 psig at 100° F. for a reflex gage 210 and a gage rating of 3000 psig at 100° F. for a transparent gage 310*a*. The cover 209 weighs 9 lbs. Using the same chamber block 12 and lens 14 with a conventional cover 9 weighing 8¾ lbs, the gage rating of the conventional reflex gage 10 is only 2250 psig at 100° F. and the gage rating of the conventional transparent gage 110*a* is only 1000 psig at 100° F. Thus with an almost negligible increase in weight, the new gage cover provides very substantial enhancement of gage pressure capacity. In addition to providing the gage greater pressure capacity, the gage cover 209 of the invention has reduced tension at its ends, and accordingly, has a longer projected life under high pressure conditions.

While the invention has been described in terms of certain preferred embodiments, modifications obvious to one with ordinary skill in the art may be made without departing from the scope of the present invention.

Various features of the invention are set forth in the following claims.

What is claimed is:

1. In an improved liquid sight gage, including an improved cover; an elongated chamber block having longitudinally extending sidewalls and transversely extending endwalls connecting the sidewalls to define an elongated liquid chamber having an opening, and port means for communicating the liquid chamber with a liquid-containing vessel; a transparent lens covering said liquid chamber opening; sealing means for forming a seal between the lens and the chamber block; and a plurality of longitudinally spaced bolt means connecting said cover to the chamber block, the lens being disposed between the cover and the chamber block; the improved cover comprising a pair of spaced, transversely extending end sections and a pair of spaced, longitudinally extending side beams defining a viewing slot into the liquid chamber, said side beams extending transversely outwardly of said chamber block, and a plurality of longitudinally spaced holes in said side beams disposed outwardly of said chamber block for receiving the bolt means, said side beams having substantially continuously progressively increasing masses from said end sections to their centers, whereby said cover increasingly resists the increasing tendency of more central portions of the sidewalls to deflect when subjected to liquid pressure.

2. A cover according to claim 1 wherein said side beams have progressively greater transverse dimensions intermediate said end sections of said cover.

3. A cover according to claim 1 wherein said side beams have progressively greater depth intermediate said end sections of said cover.

4. A cover according to claim 1 wherein at least central portions of said side beams extend over the chamber sidewalls.

5. A cover according to claim 1 wherein said side beams are provided with an ovate edge.

6. A cover according to claim 1 wherein said holes are positioned so that the bolt means extend in contact with the chamber sidewalls.

7. A cover according to claim 6 wherein at least central portions of said side beams extend along the bolt means and over the sidewalls, thereby reinforcing the bolt means in the transverse direction.

8. A cover according to claim 7 wherein said side beams have generally ovate configurations extending over the sidewalls, said side beams having ribs reinforcing the bolt means in the transverse direction.

9. In an improved liquid sight gage, including an improved cover; an elongated chamber block having a front surface, longitudinally extending sidewalls and transversely extending endwalls connecting the sidewalls to define an elongated liquid chamber having an opening to said front surface, and port means for communicating the liquid chamber with a liquid-containing vessel; a transparent lens overlying said front surface and covering said liquid chamber opening; sealing means for forming a seal between the lens and said front surface of the chamber block; and a plurality of longitudinally spaced bolt means connecting said cover to the chamber block, the lens being disposed between the cover and the chamber block; the improved cover comprising a pair of spaced, transversely extending end sections and a pair of spaced, longitudinally extending side beams defining a viewing slot into the liquid chamber, said side beams extending transversely outwardly of said chamber block and having portions extending substantially continuously rearwardly of said front surface, and a plurality of longitudinally spaced holes in said side beams disposed outwardly of said chamber block for receiving the bolt means, said bolt means and rearwardly extending portions of said side beams being disposed in abutting relationship to the sidewalls so as to directly receive pressure transversely transmitted through said sidewalls from said liquid chamber, whereupon the pressure creates a moment of bending in said cover generally at the level of said front surface, which bending moment places a compression component of stress on substantially all portions of said end sections, thereby eliminating or reducing tension forces in said end sections.

10. A gage in accordance with claim 9 wherein said bolt means extend in contact with the chamber sidewalls and on their outer side in contact with rearwardly extending portions of said side beams, whereby pressure from said chamber is transmitted transversely through said sidewalls, to said bolt means, and transversely from said bolt means to said side beams.

11. An improved liquid sight gage, including an improved cover; an elongated chamber block having longitudinally extending sidewalls and transversely extending endwalls connecting the sidewalls to define an elongated liquid chamber having an opening, and port means for communicating the liquid chamber with a liquid-containing vessel; a transparent lens covering said liquid chamber opening; sealing means for forming a seal between the lens and the chamber block; and a plurality of longitudinally spaced bolt means connecting said cover to the chamber block, the lens being disposed between the cover and the chamber block; the improved cover comprising a pair of spaced, transversely extending end sections and a pair of spaced, longitudinally extending side beams defining a viewing slot into the liquid chamber, said side beams extending transversely outwardly of said chamber block, and a plurality of longitudinally spaced holes in said side beams disposed outwardly of said chamber block for receiving the bolt means, said side beams having progressively increasing masses from said end sections to their centers, which increasing mass is provided by continuously increasing transverse dimensions and continuously increasing depths of said side beams from said end sections toward their centers, central portions of said side beams extending to an increasing depth along the chamber sidewalls for supporting the same, whereby said cover increasingly resists the increasing tendency of more central portions of the sidewalls to deflect when subjected to liquid pressure.

12. A cover according to claim 11 wherein said side beams are provided with an ovate edge.

13. A cover according to claim 11 wherein said side beams are positioned so that the bolt means extend in contact with the chamber sidewalls.

14. A cover according to claim 12 wherein at least central portions of said side beams extend along the bolt means and over the sidewalls, thereby reinforcing the bolt means in the transverse direction.

15. A cover according to claim 12 wherein said side beams have generally ovate configurations extending over the sidewalls, said side beams having ribs reinforcing the bolt means in the transverse direction.

* * * * *

UNITED STATES PATENT AND TRADEMARK OFFICE

CERTIFICATE OF CORRECTION

PATENT NO. : 4,561,305

DATED : December 31, 1985

INVENTOR(S) : David L. Tremain; Burt L. Beach; David J. Rimington

It is certified that error appears in the above-identified patent and that said Letters Patent is hereby corrected as shown below:

Column 1, Line 52, change "suported" to --supported--.

Column 2, Line 15, change "accomodate" to --accommodate--.

Line 35, change "accomodate" to --accommodate--.

Column 5, Line 14, after "42a," insert --62a,--.

Line 18, after "42a," insert --62a--.

Signed and Sealed this

*Twenty-seventh* Day of *May 1986*

[SEAL]

*Attest:*

DONALD J. QUIGG

*Attesting Officer*

*Commissioner of Patents and Trademarks*